US011827498B1

(12) United States Patent
Stihel et al.

(10) Patent No.: US 11,827,498 B1
(45) Date of Patent: Nov. 28, 2023

(54) PORTABLE POSITIONAL SCANNING LANE

(71) Applicant: National Technology & Engineering Solutions of Sandia, LLC, Albuquerque, NM (US)

(72) Inventors: Gregory C. Stihel, Tijeras, NM (US); Samuel Leininger, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 226 days.

(21) Appl. No.: 17/237,643

(22) Filed: Apr. 22, 2021

(51) Int. Cl.
*B66C 13/46* (2006.01)
*B66C 19/00* (2006.01)
*B65D 88/12* (2006.01)

(52) U.S. Cl.
CPC ..... *B66C 13/46* (2013.01); *B65D 88/121* (2013.01); *B66C 19/007* (2013.01)

(58) Field of Classification Search
CPC ..... B66C 13/46; B66C 19/007; B65D 88/121; G01V 5/0008; G01V 5/0066; G01V 5/0091
See application file for complete search history.

(56) References Cited

U.S. PATENT DOCUMENTS 3,051,098 A * 8/1962 Gutridge ..... B61B 1/005 410/87
RE30,914 E * 4/1982 Chisum ..... B21D 1/12 901/41
5,838,759 A * 11/1998 Armistead ..... G01V 5/0091 378/57
7,037,030 B2 * 5/2006 McLemore ..... E01F 13/048 404/6
7,134,562 B2 * 11/2006 Burkett ..... E02D 7/18 212/231
7,379,530 B2 * 5/2008 Hoff ..... G01V 5/0016 378/57
7,663,109 B2 2/2010 Kang et al.
7,819,580 B2 * 10/2010 Song ..... G01V 5/0016 378/57
7,966,686 B2 * 6/2011 Turner ..... B60S 3/063 52/844
8,503,605 B2 * 8/2013 Morton ..... G01V 5/0016 378/57
10,007,019 B2 6/2018 Morton et al.
10,416,340 B2 * 9/2019 Karas ..... G01V 5/0008
(Continued)

*Primary Examiner* — Gregory W Adams
(74) *Attorney, Agent, or Firm* — Daniel J. Jenkins

(57) ABSTRACT

A positional lane scanner and method therefor includes a positional lane cargo scanning structure having a first frame portion, a second frame portion, and a top frame portion connected to define a passage lane for a cargo vessel. The first and second frame portions are located on opposite sides and cargo vessels pass therebetween. The first and second frame portions, or both, include a first housing portion and a scanning device mounted within the first housing portion. A lifting member is provided on the top frame portion facing outward, or if the lifting means is on a transport vehicle, such as a reach spreader, a pair of lifting beams may be arranged on the transport vehicle. The lift member removably connects with a boom portion of the transport vehicle for positioning and relocating the scanning structure to be disposed adjacent a cargo vessel lane.

17 Claims, 3 Drawing Sheets

(56) References Cited

U.S. PATENT DOCUMENTS

| | | | | |
|---|---|---|---|---|
| 2007/0201972 | A1* | 8/2007 | Tsuji | B60K 17/16 414/718 |
| 2014/0185771 | A1* | 7/2014 | Morton | G01V 5/0041 378/86 |
| 2015/0219786 | A1* | 8/2015 | Wieschemann | B66F 9/063 378/57 |

* cited by examiner

PORTABLE POSITIONAL SCANNING LANE

STATEMENT REGARDING FEDERALLY SPONSORED RESEARCH OR DEVELOPMENT

This invention was developed under Contract No. DE-NA0003525 awarded by the United States Department of Energy/National Nuclear Security Administration. The Government has certain rights in this invention.

BACKGROUND OF THE INVENTION

The application generally relates to a scanning lane apparatus for cargo containers. The application relates more specifically to a positional scanning lane that is portable for use in scanning cargo containers at seaports.

Transshipment seaports are high priority seaports due to the volume of cargo containers entering a country, and potential security threats due to their many connections with other ports located throughout the world. The incoming and outgoing containers must be scanned in order to detect dangerous and illegal contents within the enclosed and sealed containers. Scanning of transshipped containers poses a unique challenge for anyone wishing to setup a system for radiation detection as well as to scan a large volume of containers, while providing a minimal set of equipment. Limited options are currently available to provide transshipment scanning. Moreover, the land area required for current container ports is extremely large. Currently operating container ports are increasingly unable to handle the volumes of containers arriving and leaving the ports as more and larger container ships arrive. Thus, seaport space is limited for accommodating scanning equipment.

The positional scanning lane is a concept to address transshipment scanning at large seaports where traditional fixed radiation detection systems are not feasible due to the size of port, the amount of equipment needed, and the variations in traffic flows and patterns. With transshipment traffic, containers are moved from an arriving ship and driven, by truck, to a location within the stacks. Upon departure, those containers are retrieved, placed on another truck and moved to a loading area for the ship. Due to variations in ship sizes, port locations, and stacking areas, transshipment is often not captured in the scanning lane detection (SLD) program; however, a significant risk and subsequent opportunity for large numbers of radiation scans exists at these facilities. Until the development of self-propelled radiation detection platforms, limited transshipment scanning solutions existed. The positional scanning lane 10 addresses these concerns at a much lower operating and lifecycle cost.

This concept presents an idea to address some the challenges to transshipment scanning and the procurement, operational and lifecycle costs by use of a simple, cost-effective movable radiation detection platform without the high costs of a self-propelled system.

What is needed is a system and/or method that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY OF THE INVENTION

One embodiment relates to a positional lane scanner. In one aspect, a positional lane cargo scanning structure includes a first frame portion, a second frame portion, and a top frame portion connected to define a passage lane for a cargo vessel. The first and second frame portions are located on opposite sides and cargo vessels pass therebetween. The first and second frame portions, or both, include a first housing portion and a scanning device mounted within the first housing portion. A lifting member is provided on the top frame portion facing outward, or if the lifting means is on a transport vehicle, such as a reach stacker, top hander or crane equipped with a ISO container handling spreader bar, a pair of lifting beams may be arranged on the transport vehicle. The lift member removably connects with a boom portion of the transport vehicle for positioning and relocating the scanning structure to be disposed adjacent a cargo vessel lane.

Another embodiment relates to a method of inspecting cargo vessels at a transshipment site. The method includes providing a positional lane cargo scanning structure having a first housing portion and a scanning device mounted within the first housing portion; connecting a first frame portion, a second frame portion and a top frame portion to define a passage lane wherein first and second frame portions are disposed on opposite sides of the top frame portion; passing cargo vessels through the positional lane cargo scanning structure for detecting properties of contents of the cargo vessel; scanning the cargo vessel as the cargo vessel proceeds through the positional lane cargo scanning structure; repositioning the positional lane cargo scanning structure via a lifting member connected to the top frame portion on an outward-facing side; and transporting the positional lane cargo scanning structure to various locations at the transshipment site for scanning cargo vessels by removably connecting the positional lane cargo scanning structure with a boom on a transport vehicle.

Certain advantages of the embodiments described herein include significant advantages over self-propelled systems, such as, but not limited to, reduced personnel requirements. The positional scanning lane 10 may be unmanned while trucks drive through the lane. This feature provides a safety advantage, as well as reduces cost to build an onboard cage for the driver and CAS. Staffing requirements are reduced since an operator or driver does not sit in the machine. The positional scanning lane system is moved using readily available seaport equipment such as a reach stacker.

Training requirements are reduced as port-owned reach stackers may be used instead of conventional mobile lane scanners; therefore, unlike self-propelled systems, additional driver training is not needed.

Reduced operating and maintenance costs may be realized as total power consumption is reduced. Small generators or battery banks may be used to power the RPM or other sensors, camera systems and electronics. During downtime, the unit can be charged at a generator or the batteries replaced and recharged.

Operating and maintenance costs may be transferred to the port as the facility's existing fleet of reach stackers or other handling equipment will move the positional scanning lane 10.

Lifecycle costs may be significantly reduced by alleviating the generators, drivetrain, air conditioning associated with drivers, maintenance and operation of the system.

Reduced procurement and logistics costs may be realized. The simplified frame structure is less expensive to build than a self-propelled model, as the disclosed embodiment does not include the driver cabin or drive train, or other moving parts, and it is more easily maintained onsite.

Reduced logistics and ease of assembly is provided as the complete system may fit in one forty foot container or shipped fully assembled.

Alternative exemplary embodiments relate to other features and combinations of features as may be generally recited in the claims.

BRIEF DESCRIPTION OF THE DRAWINGS

The application will become more fully understood from the following detailed description, taken in conjunction with the accompanying figures, wherein like reference numerals refer to like elements, in which.

DETAILED DESCRIPTION OF THE INVENTION

Before turning to the figures which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Figure 1:
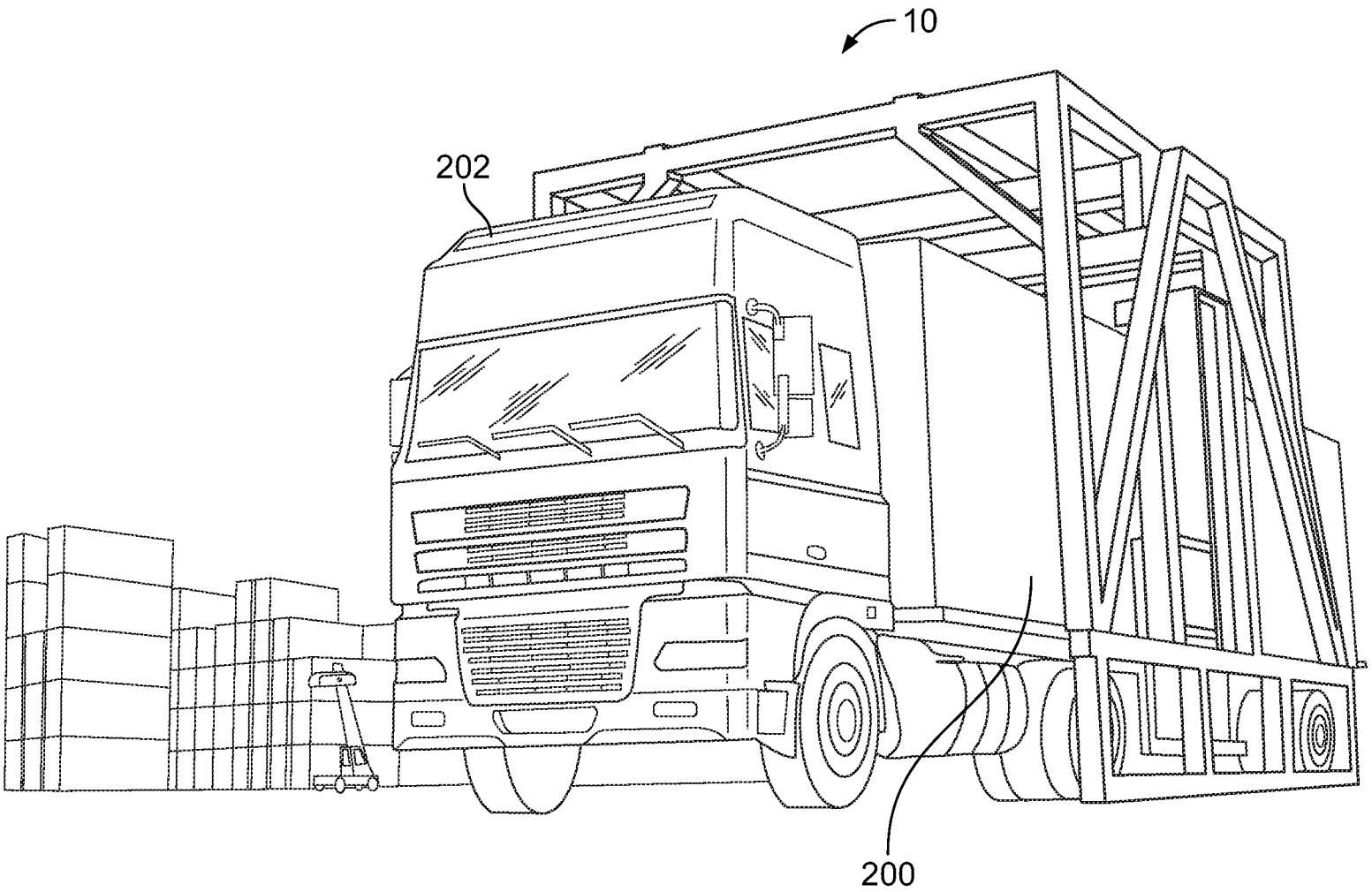
FIG. 1 is a perspective view of an exemplary positional scanning lane of the disclosure showing a transport vehicle and cargo vessel passing through the scanning lane.
Figure 2:
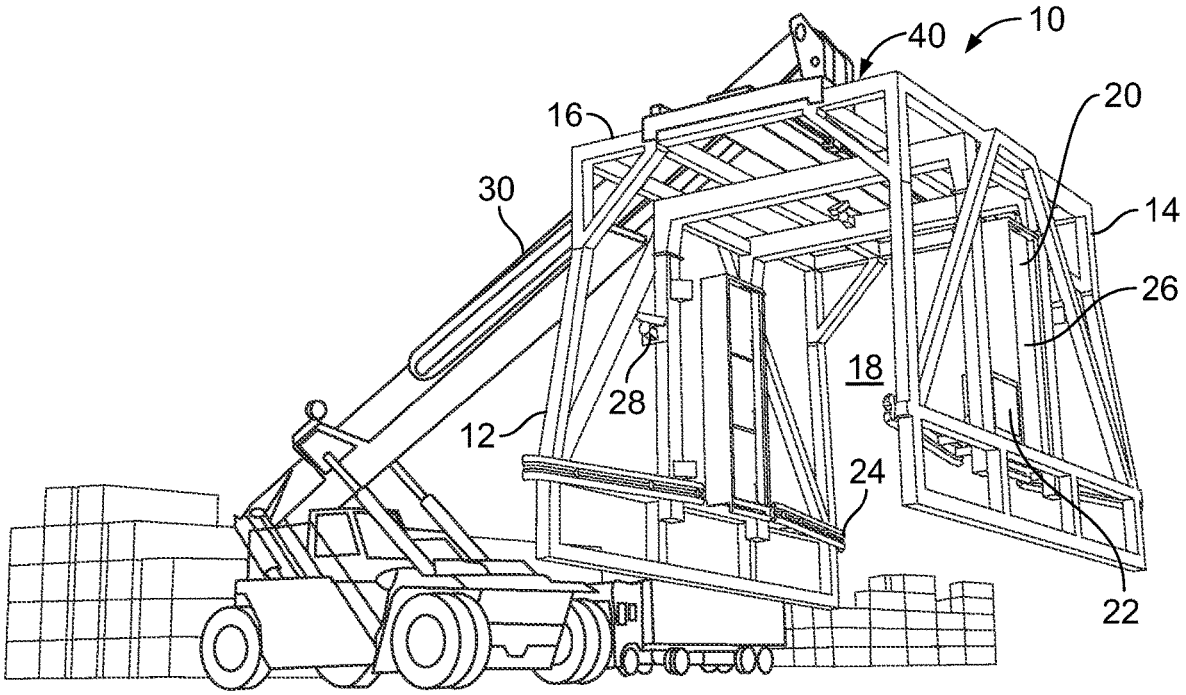
FIG. 2 is a perspective view of the positional scanning lane of FIG. 1 being repositioned on a seaport by a reach spreader.

Referring to FIG. 1, a positional lane cargo scanning structure 10 is shown. A transport vehicle 202 carrying a shipping or cargo vessel 200 is traversing through the structure for scanning. Referring next to FIG. 2, the positional scanning lane 10 is shown being repositioned on a seaport by a reach spreader 30. Positional lane cargo scanning structure 10 includes a first frame portion 12 and a second frame portion 14 on opposite sides of the passage lane 18. Frame portions 12, 14 are opposite hand configurations. A top frame portion 16 connects the first and second frame portions 12, 14 at the top to define the passage lane 18 with first and second frame portions on opposite sides of the top frame portion for passing cargo vessels therebetween.

The first and second frame portions may include a housing portion 20 for receiving a scanning device 26. The scanning device 26 is mounted within the housing portion 20. The housing portion 20 may be present in one or both of the first and second frame portions. In at least one embodiment, the respective scanning devices are fixed directly opposite one another for alignment while scanning cargo vessel 200, to accommodate scanning equipment that operates on both sides of scanning lane 10, e.g., radiation sensing equipment that may transmit signals that penetrate the cargo vessel 200.

In an embodiment, top frame portion 16 may include lifting member (not show) connected to the top frame portion 16 on an outward-facing side. In an alternate embodiment, top frame portion 16 may be a pair of lifting beams arranged for coupling with a reach spreader or other conventional lifting equipment found at seaports or other intermodal sites.

For example, the lift member 40 may be arranged to couple with a boom on transport vehicle for positioning and relocating the scanning lane structure 10.

The scanning device 26 may be a radiation sensor, an x-ray machine, a thermal sensing device, or other scanning equipment commonly used at seaports to inspect or scan cargo containers, or vessels. Lifting member 40 may be any ISO standard configuration for a container lifting frame.

In another embodiment, a thermal imaging device 28 may be mounted somewhere on the first or second frame portion 12, 14, or the top frame portion 16 for sensing thermal gradients within a cargo vessel 200. Alternately, or in addition, video cameras or photographic equipment may be mounted on frame portions 12, 14, 16, for viewing and recording images of cargo vessels moving through scanning lane 10.

A second housing portion 22 is provided for placement of computer communications apparatus. The computer communications apparatus is interconnected with and in data communication with the scanning device to receive scanned data and to transmit control and other instructions to the scanning device. In an embodiment, the computer communications apparatus may be programed to receive and process data from the scanning device and transmit the processed data to a remote processor over hardwired or wireless network connections.

In one embodiment, a guardrail portion 24 may be disposed in passage lane 18 on an inward-facing side of each of first and second frame portions 12, 14. Guardrail portion 24 extends longitudinally through passage lane 18, generally parallel with a center line 134 (see FIG. 4) of the passage lane 18. Guardrail 24 may be arranged to direct a cargo vessel from contacting either of first and second frame portions and the respective housing portions while passing through passage lane 18.

Figure 3:
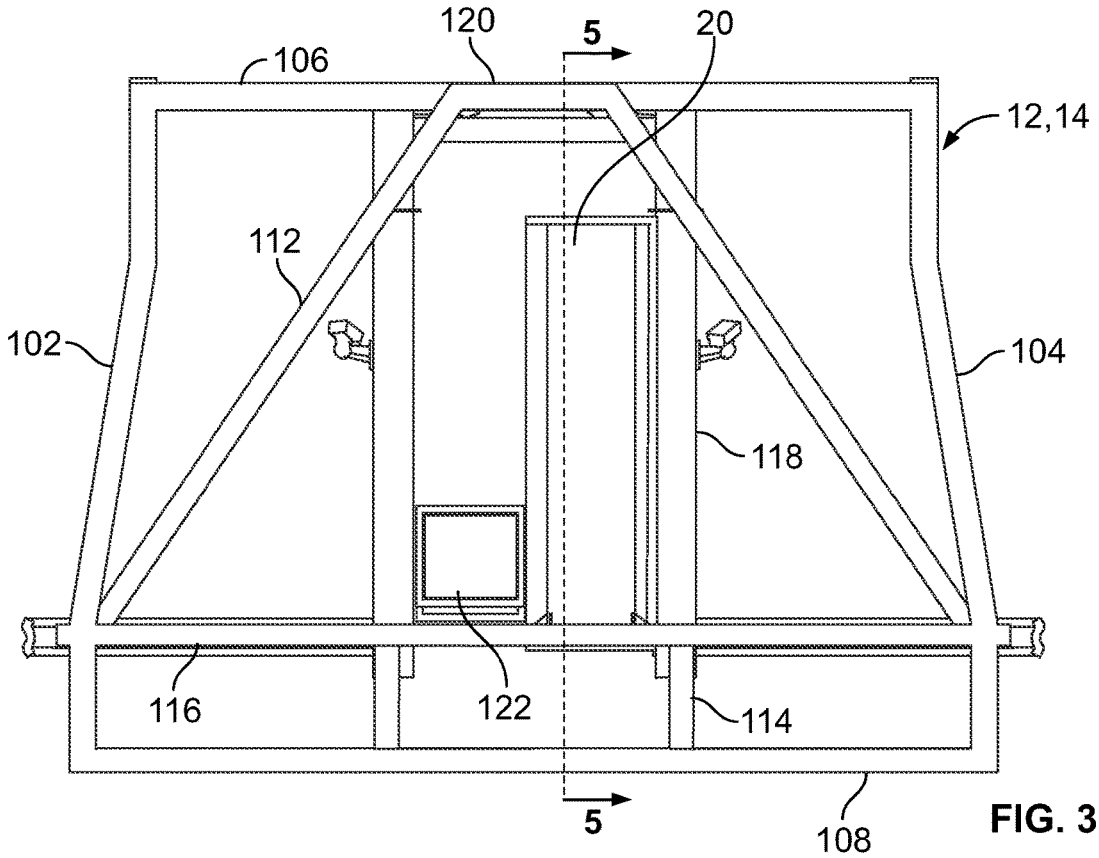
FIG. 3 is a side view of an exemplary embodiment of a positional scanning lane.
Figure 4:
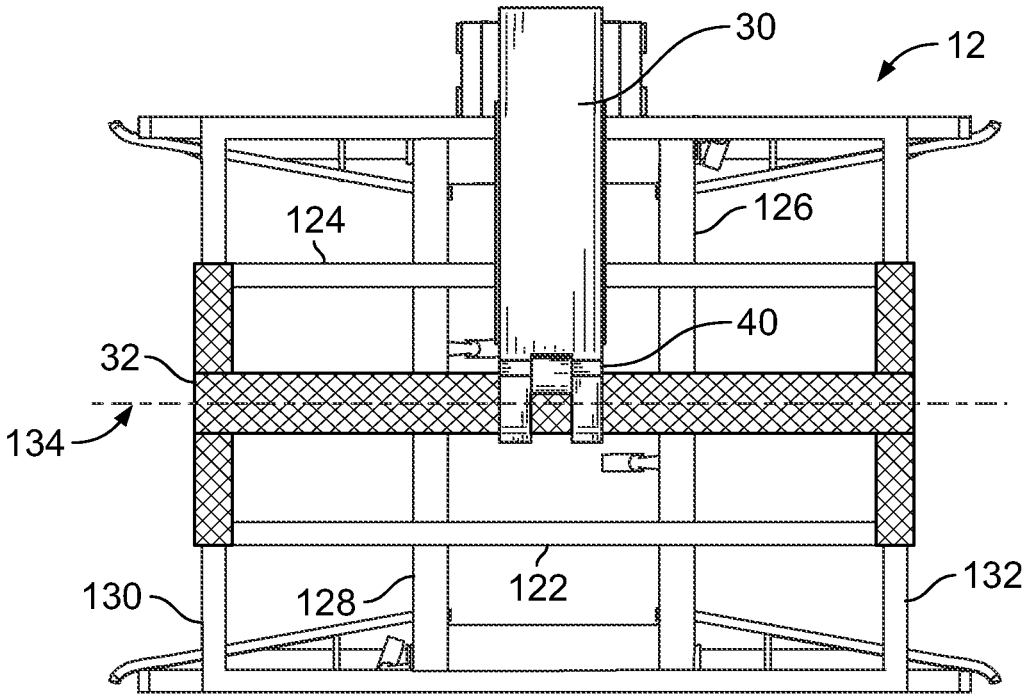
FIG. 4 is a top view of the positional scanning lane of FIG. 3.

Referring next to FIGS. 3 and 4, each of the first and second frame portions 12, 14 are illustrated. Each frame portion has two pair of structural members. Upright or vertical structural members 102, 104, and horizontal members 106, 108. The pair of vertical members 102, 104 and the second pair of horizontal structural members 106, 108 connects the first pair of vertical members to form a rectangular frame, generally.

Intermediate structural members 118 may be connected between the horizontal structural members 106, 108 and spaced apart between the vertical structural members 102, 104. The exemplary embodiment of FIG. 3 shows two intermediate members, but more members, or fewer members, may be provided as needed to provide sufficient rigidity to the scanning lane structure 10. Scanning equipment housing portion 20 is placed between the intermediate members 118 and supported by a lateral beam 116 extending longitudinally on the respective frame portion 12 or 14. The lateral beam is generally parallel with the scanning lane center line 134 (FIG. 4).

Figure 5:
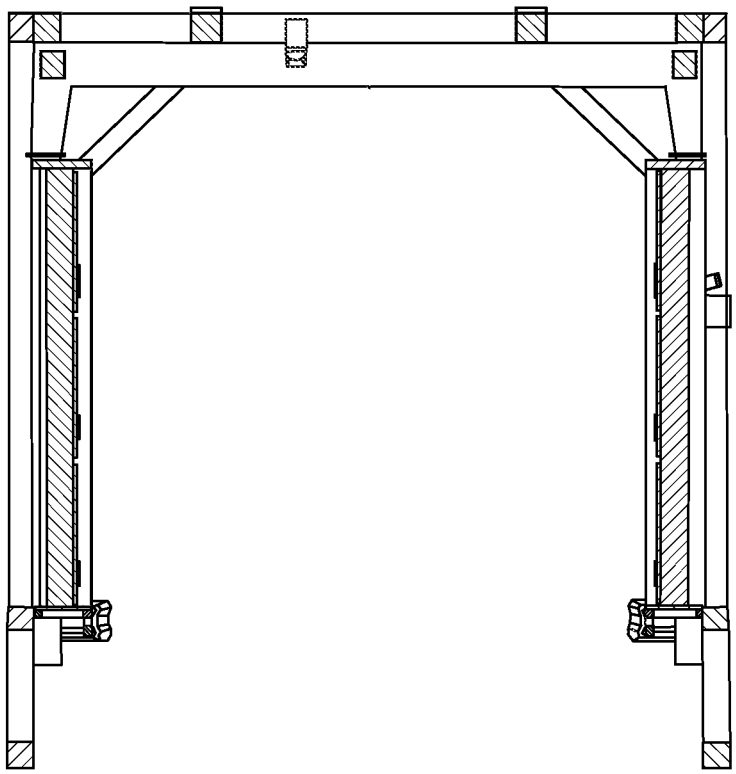
FIG. 5 is a cross-sectional view of the positional scanning lane taken along the lines 5-5 in FIG. 3.

Referring next to FIGS. 4 and 5, top portion 16 has lateral members 126 connected at opposite ends to respective intermediate members 118 of the first and second frame portions 12, 14 to form the rigid frame over the passage lane 18. In an alternate embodiment, a flat bottom portion (not shown) may be provided opposite the top frame portion 16 spanning between the first and second frame portion to provide a floor of the scanning lane, effectively enclosing the structure on all sides with passage openings at both ends. A bottom portion may help to reinforce the structure where necessary to accommodate the weight, and for maintaining the parallel separation the first and second frame portions along bottom frame member 108.

In still another embodiment, the rectangular frame portion first and second upright beams 102, 104 include angled brace members 112 that may extend at an angle between the upright beams 102, 104 and the upper horizontal beam 106. Angled brace members 112 are connected at the top ends by a connecting beam segment 120 adjacent to the upper horizontal beam 106. Intermediate members 118 are disposed between the first and second upright members 102, 104 and parallel with the upright members. Lateral member 116 extends longitudinally between the upright members and parallel with the bottom horizontal member 108. Leg portions 114 are positioned vertically between the lateral member 116 and the bottom horizontal member 108. Housing portion 20 is disposed between intermediate members 118 and supported by lateral member 116.

Referring again to FIG. 4, top frame portion 16 is constructed of cross beams 126 extending between upper horizontal beams 106, of the first and second frame members 12, 14 respectively, at opposite ends. Lifting beams 124 extend longitudinally between cross beams 126. Lifting beams 124 may be spaced symmetrically about a longitudinal center line 134 of the scanning lane, to balance the load during transport. Lifting beams 124 may be designed to couple with a lifting apparatus 30 for repositioning.

Scanning device 26 may be a radiation detection system configured to detect the presence of gamma and neutron radiation utilizing a vehicle monitor-type radiation portal monitor. Alternately, scanning device 26 may be a secondary spectroscopic detection system. The secondary spectroscopic detection system may be configured to identify isotopes and source locations of a threat material, and may also include a spectroscopic portal monitor.

An electrical power source may be connected to a diesel generator, a shore power source, or a battery bank to supply power to scanning lane structure 10.

The communications system includes Ethernet® connectivity or cellular data for secure remote applications. The scanning lane structure 10 may be monitored locally or may transmit camera images and radiation detector scan data to a remote computer system for remote monitoring.

A data collection system may be provided for on-board data acquisition and processing. The data collection may be performed on board and the data transmitted via a standard formatted message, e.g., (XML) to a CAS or locally to a laptop, tablet or other connected device.

In operation, a positional scanning lane 10 differs from the self-propelled platform primarily in the following ways: the self-propelled unit moves under its own power and is driven to the scanning location. It is fundamentally a straddle carrier equipped with radiation detectors, visual identification systems and a computer system to collect and transmit radiation detection data wirelessly to a central alarm station. The positional scanning lane 10 is similar in concept to a self-propelled unit, but is conceived to be moved using the existing port equipment using the standard ISO twist lock connectors on spreader bars mating to integrated corner castings in the positional scanning lane 10 frame to a location that is useful to the current transshipment activity. While the design shown in FIG. 1 is notional, it provides an idea of what this system could look like.

During discharge of containers from the vessel, the positional scanning lane 10 would be placed in a location where yard trucks would drive through the positional scanning lane 10 immediately after being loaded. Scanning rates are approximately 200 trucks per hour, and based on operational experience using similar configurations, there is very little, if any, impact on port operations. Positioning of the positional scanning lane 10 is achieved by a reach stacker latching to the twist lock points built into the frame and placed where needed, as shown in FIG. 2. During transshipment, the positional scanning lane 10 is placed on the quay or anywhere in the traffic pattern where the trucks are carrying containers to the stacks as shown in FIG. 1. During scanning, data is transferred to the CAS over an infrastructure wireless network or over an alternate wireless system such as cellular or a separate wireless network, or alarms could be adjudicated locally. Once scanning is complete, the positional scanning lane 10 can be moved to an out-of-the-way location or to another transshipment point.

The positional scanning lane 10 may be equipped with any suitable radiation detection system as required, e.g., a primary detection system capable of detecting the presence of gamma and neutron radiation could utilize a typical vehicle monitor-type radiation portal monitor. A secondary spectroscopic detection system capable of identifying isotopes and source locations of threat materials may utilize a spectroscopic portal monitor or other spectroscopic system.

Fixed camera 28 may include optical character recognition systems to capture container numbers and truck license plates. A global positioning system is provided to give the positional scanning lane 10 location on the terminal. Traffic signals may also be included to indicate positional scanning lane 10 readiness, alarm conditions, and may be used for traffic diversion.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any process or method steps may be varied or re-sequenced according to alternative embodiments.

The embodiments of the present application may be implemented using an existing computer processor, or by a special purpose computer processor for an appropriate system, incorporated for this or another purpose or by a hardwired system.

It is important to note that the construction and arrangement of the positional scanning lane as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

The invention claimed is:

1. A positional lane cargo scanning structure comprising:

a first frame portion, a second frame portion, and a top frame portion connecting the first and second frame portions to define a passage lane with first and second frame portions on opposite sides of the top frame portion for passing cargo vessels therebetween;

wherein at least one of the first and second frame portions comprises a housing portion and a scanning device mounted within the housing portion; and a lifting member connected to the top frame portion on an outward-facing side;

the lift member configured to removably connect with a repositioning member on a transport vehicle for positioning and relocating the scanning structure;

wherein each of the first frame portion and the second frame portion comprise:

first and second upright beams disposed at opposite ends of the respective frame member; the first and second upright beams connected at an upper end respectively by an upper horizontal beam and at a bottom end by a bottom horizontal beam; and a pair of angled brace members extending at an angle between the upright beams and the upper horizontal beam; the angled brace members connected by a connecting beam segment adjacent the upper horizontal beam and wherein the structure further comprises:

a pair of intermediate members disposed between the first and second upright members and parallel with the upright members; and a lateral member extending longitudinally between the upright members and parallel with the bottom horizontal member; a plurality of leg portions disposed vertically between the lateral member and the bottom horizontal member.

2. The structure of claim 1, wherein the scanning device is selected from a radiation sensor, an x-ray machine, or a thermal sensing device.

3. The structure of claim 1, wherein the lifting member is an ISO standard configuration container lifting frame.

4. The structure of claim 1, wherein both of the first and second frame portions comprises the housing portion and the scanning device mounted within the first housing portion, the respective scanning devices fixed directly opposite one another for alignment while scanning a cargo vessel.

5. The structure of claim 1, further comprising at least one thermal imaging device mounted on at least one frame portion for sensing thermal gradients within a cargo vessel.

6. The structure of claim 1, further comprising a second housing portion for placement of computer communications apparatus, the computer communications apparatus in data communication with the scanning device; the computer communications apparatus configured to receive and process data from the scanning device and transmit the processed data to a remote processor.

7. The structure of claim 1, further comprising a guardrail portion disposed on an inward-facing side of each of first and second frame portions, the guardrail portion extending longitudinally parallel with a center line of the passage lane; the guardrail configured to direct a cargo vessel away from contact with the first and second frame portions and the respective housing portions.

8. The structure of claim 1, wherein each of the first and second frame portions comprising:

at least two pair of structural members and, the first pair disposed vertically and the second pair of structural members disposed horizontally between the first pair and defining a rectangle, and a pair of intermediate structural members connected between the pair of horizontal structural members and spaced apart between the vertical structural members;

the first housing portion disposed between the intermediate members and supported by a lateral beam extending longitudinally on the respective frame portion and parallel with the scanning lane center line; and the top portion comprising a pair of lateral members, each of the lateral members connected at opposite ends to respective intermediate members of first and second frame portions to form a rigid frame over the passage lane.

9. The structure of claim 1, wherein the housing portion is disposed between the intermediate members and supported by the lateral member.

10. The structure of claim 9, further comprising: wherein the first frame portion and the second frame portion are arranged opposite one another in mirror image relation.

11. The structure of claim 10, wherein the top frame portion comprises:

a pair of cross beams extending between the first and second frame members upper horizontal beams, respectively, at opposite first and second ends of the respective beams;

and a pair of lifting beams extending longitudinally between the pair of cross beams;

the lifting beams spaced symmetrically about a longitudinal center line of the scanning lane and configured to couple with a lifting apparatus for repositioning.

12. The structure of claim 10, wherein the scanning devise comprises a radiation detection system.

13. The structure of claim 10, wherein the scanning device is configured to detect the presence of gamma and neutron radiation utilizing a vehicle monitor-type radiation portal monitor.

14. The structure of claim 10, wherein the scanning device comprises a secondary spectroscopic detection system; the secondary spectroscopic detection configured to identify isotopes and source locations of a threat material, wherein the scanning device further comprises a spectroscopic portal monitor.

15. The structure of claim 10, wherein the communications system includes Ethernet connectivity or cellular data for secure remote applications; wherein the structure can be monitored locally transmit camera images and radiation detector scan data to a remote computer system.

16. The structure of claim 10, further comprising a data collection system for on-board data acquisition and processing; the data collection performed on board and data transmitted via a standard formatted message to the remote computer system or to a computer device disposed on the structure.

17. A method of inspecting cargo vessels at a transshipment site comprising:

connecting a first frame portion, a second frame portion and a top frame portion to form a positional cargo scanning structure that defines a passage lane wherein first and second frame portions are disposed on opposite sides of the top frame portion;

providing a positional lane cargo scanning structure having a first housing portion and a scanning device mounted within the positional cargo scanning structure;

passing cargo vessels through the positional lane cargo scanning structure for detecting properties of a contents of the cargo vessel;

scanning the cargo vessel as the cargo vessel proceeds through the positional lane cargo scanning structure;

repositioning the positional lane cargo scanning structure via a lifting member connected to the top frame portion on an outward-facing side; and transporting the positional lane cargo scanning structure to various locations at the transshipment site for scanning cargo vessels by removably connecting the positional lane cargo scanning structure with a boom on a transport vehicle;

wherein each of the first frame portion and the second frame portion comprise:

first and second upright beams disposed at opposite ends of the respective frame member; the first and second upright beams connected at an upper end respectively by an upper horizontal beam and at a bottom end by a bottom horizontal beam; and a pair of angled brace members extending at an angle between the upright beams and the upper horizontal beam; the angled brace members connected by a connecting beam segment adjacent the upper horizontal beam and wherein the structure further comprises:

a pair of intermediate members disposed between the first and second upright members and parallel with the upright members; and a lateral member extending longitudinally between the upright members and parallel with the bottom horizontal member; a plurality of leg portions disposed vertically between the lateral member and the bottom horizontal member.

* * * * *